United States Patent [19]

Koyabu et al.

[11] Patent Number: 4,884,253

[45] Date of Patent: Nov. 28, 1989

[54] BREAD MAKING DEVICE WITH A CLOCK FUNCTION

[75] Inventors: Seiji Koyabu, Nara; Tatsuhisa Fukuda, Osaka, both of Japan

[73] Assignees: Sanyo Electric Co., Ltd.; Yamano Electric Mfg. Co., Ltd., both of Osaka, Japan

[21] Appl. No.: 195,768

[22] Filed: May 18, 1988

[30] Foreign Application Priority Data

Jun. 2, 1987 [JP] Japan ..... 62-138462
Jun. 16, 1987 [JP] Japan ..... 62-149383

[51] Int. Cl.[4] ..... G04B 47/00; H05B 1/02

[52] U.S. Cl. ..... 368/10; 368/108; 219/492

[58] Field of Search ..... 368/10, 107–113; 99/332, 333, 348, 325–328; 219/10.55 B, 492, 506

[56] References Cited

U.S. PATENT DOCUMENTS

| | | | |
|---|---|---|---|
| 4,158,432 | 6/1979 | van Bavel | 219/492 |
| 4,225,776 | 9/1980 | Meisner et al. | 219/492 |
| 4,441,016 | 4/1984 | Oota et al. | 219/492 |
| 4,695,710 | 9/1987 | Yamashita et al. | 219/492 |
| 4,776,265 | 10/1988 | Ojima | 99/348 |

*Primary Examiner*—Vit W. Miska
*Attorney, Agent, or Firm*—Darby & Darby

[57] ABSTRACT

The time period required for bread making is previously memorized in an internal memory of a bread making device. Time display panel normally displaying a present time displays a bread making finished time which is calculated by adding bread making time to the present time upon the operation of a starter button. When an appointed bread making finished time is set on the time display panel, the bread making process will be automatically started at a time which is calculated by subtracting the bread making time from the set time.

5 Claims, 4 Drawing Sheets

STARTER MEANS
16
CLOCK MEANS
11
3RD MEMORY MEANS
21
1ST MEMORY MEANS
12
2ND MEMORY MEANS
13
COMPARATOR MEANS
20
BREAD MAKING MEANS
18
TIME DISPLAY MEANS
15
CALL OUT MEANS
17

BREAD MAKING DEVICE WITH A CLOCK FUNCTION

FIELD OF THE INVENTION

The invention relates to a bread making device provided with a clock function.

BACKGROUND OF THE INVENTION

Bread making process is generally carried out through the steps of throwing yeast into flour to form bread dough, mixing or kneading and fermenting the dough alternately and repeatedly, and finally baking the dough and thereafter cooling with cool air flow. Though the required period of time for such a bread making process varies with the quantity of yeast used or the fermentation temperature, it takes about three hours and a half to the end of baking step and about four hours to complete the whole process including cooling.

It has been inconvenient to date that the user of a bread making device has to calculate by adding a bread making time to a present time to know a bread making finished time and, further, the user has to memorize himself such finished time. Such a situation has been rather cumbersome. Moreover, when the bread making is desired to be finished at a certain later time, the starting time of the bread making must be calculated back from the desired finished time and the user has to start the operation of the device at the instant of calculated starting time. Such a situation has been even more cumbersome.

BRIEF SUMMARY OF THE INVENTION

It is a primary object of the invention to overcome the above described problem in the prior art by providing a bread making device having a clock function wherein a calculated time when the bread making process will be finished is immediately displayed upon the input of starting instruction without the calculation of the finished time by the user.

Another object of the invention is to provide a bread making device having a clock function wherein an appointed bread making finished time may be displayed in response to the input by the user while the calculation of a starting time of bread making corresponding to the input time and the actual starting of the bread making at the calculated starting time may be carried out automatically.

Thus, according to the invention, there is provided a bread making device comprising:

a starter means for generating by the operation thereof a starting instruction, a clock means for counting up momentarily changing present time, a first memory means for memorizing a bread making time previously set for bread making, a second memory means for memorizing a bread making finished time calculated by adding said bread making time to present time supplied from said clock means at the moment input of said starting instruction, a display selecting means for generating normally said momentarily changing present time supplied from said clock means while generating said bread making finished time supplied from said memory means instead of momentarily changing present time in response to said starting instruction, and a time display means for displaying a time generated by said display selecting means.

Due to such construction, a bread making finished time may immediately be calculated and displayed by simply instructing the start of bread making.

Accordingly, the user will be free from such cumbersome procedures of calculating and memorizing the bread making finished time.

According to the present invention, it is preferable that the clock function in the above described bread making device further comprises a call out means for calling momentarily changing present time so that said time display means displays momentarily changing present time from said clock means selected instead of said bread making finished time by said display selecting means in response to an instruction from said call out means.

By means of such provision, it is convenient that the user may easily be informed of a present time whenever desired in the course of bread making.

According to the invention there is also provided a bread making device comprising:

a starter means for generating by the operation thereof a starting instruction, a clock means for counting up momentarily changing present time, a first memory means for memorizing bread making time previously set for bread making, a second memory means for memorizing a bread making finished time calculated by adding said bread making time to said momentarily changing present time supplied from said clock means at the moment input of said starting instruction from said starter means, a third memory means for memorizing an appointed bread making finished time, a time display means normally displaying momentarily changing present time supplied from said clock means while displaying, after the operation of said starter means, the bread making finished time supplied from said second memory means or the appointed bread making finished time supplied from said third memory means, and a comparator means generating output, when said starter means is operated, as a result of comparing the bread making finished time supplied from said second memory means with the appointed bread making finished time supplied from said third memory means, so as to display a later time on said time display means, while calculating and memorizing a starting time for bread making corresponding to said later time so as to instruct the starting of bread making when the momentarily changing present time supplied from said clock means coincides with said starting time.

Due to such construction, by simply setting an appointed finished time when a loaf of just made bread is desired, a starting time for bread making corresponding to such finished time is automatically calculated and the bread making will be started at thus calculated starting time automatically.

Accordingly, any calculation or memorization of starting or finished time by the user becomes unnecessary whereby the setting operation by the user may substantially be facilitated.

When a bread making finished time calculated by adding the bread making time to a present time is later than an appointed bread making finished time set by the user, the bread making finished time is displayed on the time display means. Thus, the user will, in such case, be informed of the correct bread making finished time so that there would cause no problem.

It is preferable that said comparator means generates an output for flickeringly displaying the bread making finished time on said display means when the latter time is later than the appointed finished time.

By means of such provision, the user will be noticed his false setting of an appointed finished time corresponding to a period shorter than the actually required period of bread making.

In such an embodiment as described above, it is also preferable that there is further provided a call out means for calling momentarily changing present time from said clock means whereby momentarily changing present time is displayed on said display means in response to a signal from the call out means.

By means of such provision, it is also convenient that the user may easily be informed of a present time whenever desired in the course of bread making.

BRIEF DESCRIPTION OF THE DRAWINGS

These and other objects as well as advantages of the present invention will become clear by the following description of preferred embodiments of the invention with reference to the accompanying drawings, wherein.

DETAILED DESCRIPTION OF THE PREFERRED EMBODIMENTS

An embodiment of the invention will now be described with reference to FIGS. 1 and 2.

Figure 1:
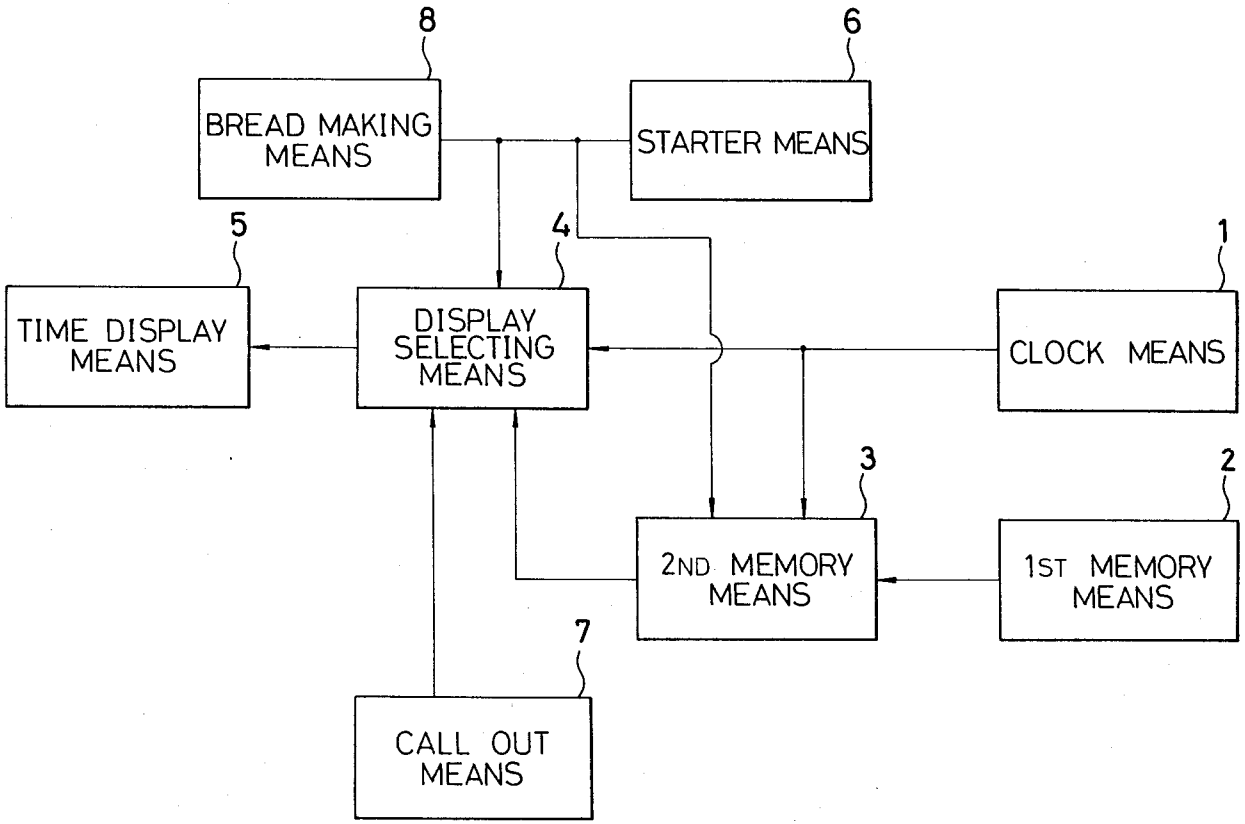
FIG. 1 is a block diagram mainly showing time processing part in an embodiment of a bread making device according to the invention.

As shown in FIG. 1, the embodiment of bread making device comprises a clock means 1, a first memory means 2, a second memory means 3, a display selecting means 4, a time display means 5, a starter means 6, a call out means 7, and a bread making means 8.

The clock means 1 always counts up momentarily changing present time which is supplied to the second memory means 3 and the display selecting means 4, respectively.

A period of time, for example, of four hours required for the making of a pound load of bread is previously memorized in the first memory means 2. Such a period of four hours is required for the bread making process comprising the steps of throwing yeast into flour to form bread dough, mixing or kneading and fermenting the dough alternately and repeatedly, baking the dough at a high temperature, and finally cooling with cool air flow to obtain the surface condition of the baked bread in pasty free. It takes a half hour for the final step of cooling. Thus, when the cooling process is unnecessary, a period of three hours and a half may previously be set on the first memory means 2.

The bread making time memorized in the first memory means 2 is supplied to the second memory means 3.

When a starting instruction is received from the starter means 6, the second memory means 3 calculates a bread making finished time by adding the required period, for example, of four hours for bread making supplied from the first memory means 2 to a present time supplied from the clock means 1 at the moment of the starting instruction, and memorizes thus calculated bread making finished time. The bread making finished time is supplied to the display selecting means 4.

The display selecting means 4 normally transmitting the momentarily changing present time supplied from the clock means 1 to the time display means 5 transmits the bread making finished time supplied from the second memory means 3, in response to the starting instruction generated from the starter means 6, instead of the momentarily changing present time. Further, when a calling out signal is received from the call out means 7 during the transmission of the bread making finished time, the display selecting means 4 will resume the transmission of momentarily changing present time instead of the bread making finished time.

Figure 2:
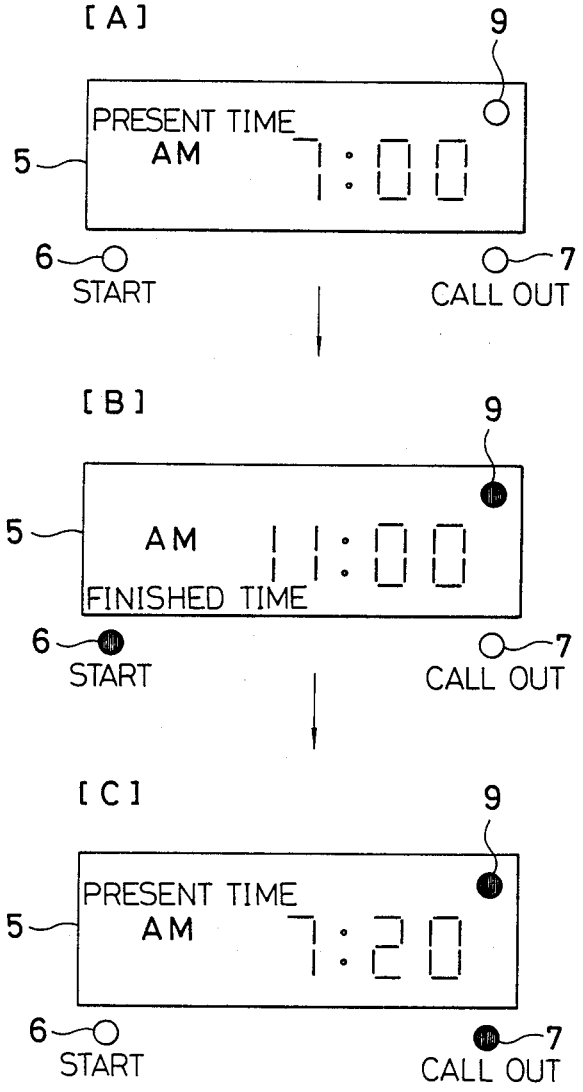
FIG. 2 is a schematic diagram illustrating an operational mode of the embodiment shown in FIG. 1.

The time display means 5 may be constituted from a displaying panel comprising such as light emitting diode and liquid crystal as shown in FIG. 2 so that the display of momentarily changing present time or the bread making finished time may be switched by the display selecting means 4.

The starter means 6 may be comprised of such as a light emitting push button switch disposed in the vicinity of the time display means 5. When the button switch is pushed, it will be lighted and a starting instruction will be generated.

Similar to the starter means 6, the call out means 7 also comprised of a light emitting push button switch disposed in the vicinity of the time display means 5 will be lighted and a calling out signal will be generated upon the operation of the button by the user.

A series of programmed controls required for bread making comprising such operations as starting in response to the starting instruction from the starter means, mixing and kneading, and fermenting may sequentially be carried out by the bread making means 8.

The operation of the embodiment constructed as mentioned above will now be described with reference to FIG. 2. Now, if the raw materials of a pound loaf of bread are thrown into a vessel of the bread making device and the starter means 6 is operated at a present time, for example, of "7:00 a.m." displayed on the time display means 5 as shown in FIG. 2(A), then the time displayed on the time display means 5 is automatically changed to "11:00 a.m." as shown in FIG. 2(B). At the same moment, a lamp of the starter means 6 and a start lamp 9 on the time display means 5 are lighted while the bread making means 8 is operated to start the bread making. The time displayed on the time display means 5 is kept in this condition during the bread making. When the momentarily changing present time is desired to know in the course of bread making, however, the call out means 7 is operated. Then, a lamp of the call out means 7 is lighted as shown in FIG. 2(C) while the time displayed on the time display means 5 is changed to the momentarily changing present time. Thereafter, the user may be informed of the finished time when the call out means 7 is operated again.

Thus, the bread making finished time is displayed coincidently with the starting of bread making by simply operating the starter means 6 so that the user will become free from rather cumbersome calculation of the finished time.

Another embodiment of the invention will now be described with reference to FIGS. 3 and 4.

Figure 3:
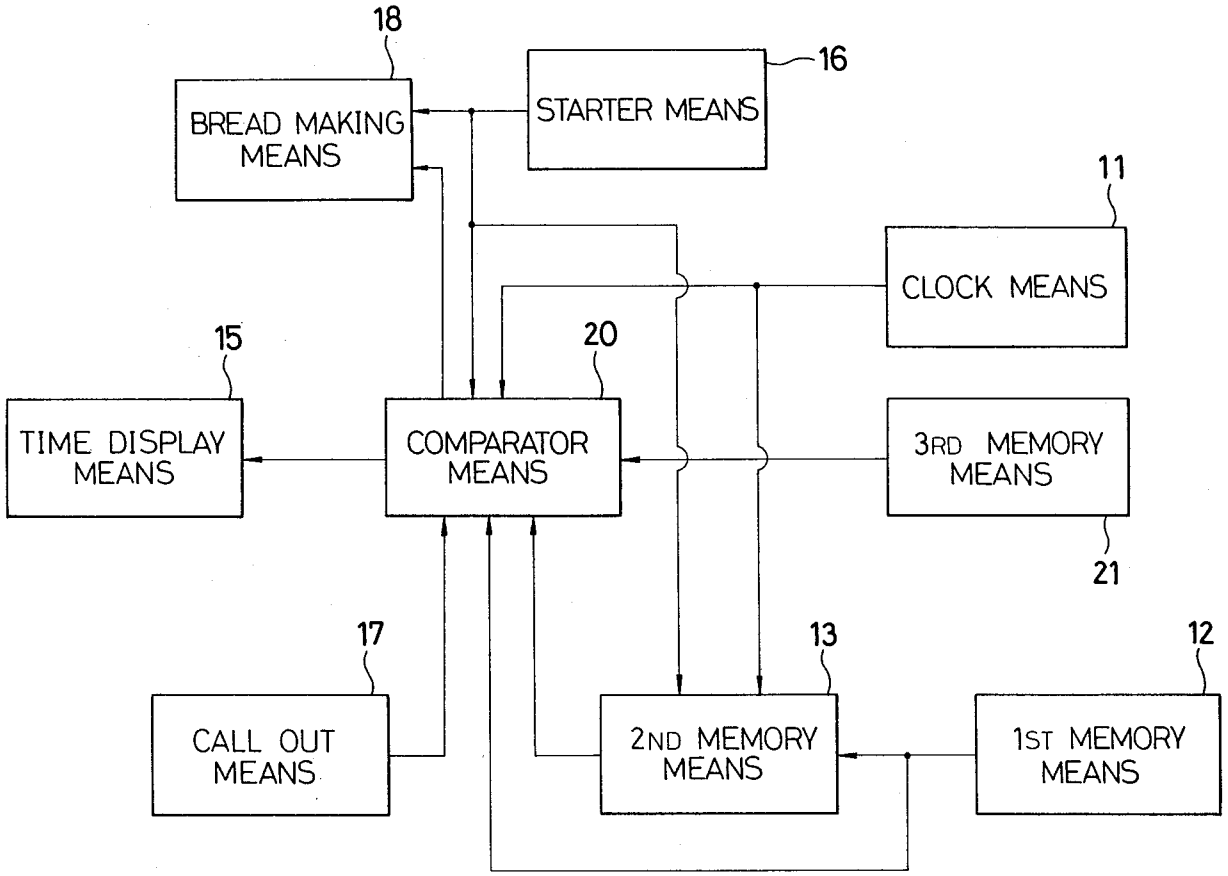
FIG. 3 is a block diagram mainly showing time processing part in another embodiment of a bread making device according to the invention.

In FIG. 3, a clock means 11, a first memory means 12, a second memory means 13, a time display means 15, a starter means 16, a call out means 17, and a bread making means 18 are, respectively, similar in function to the clock means 1, the first memory means 2, the second memory means 3, the time display means 5, the starter means 6, the call out means 7, and the bread making means 8 shown in FIG. 1. On the contrary, the construction shown in FIG. 3 is substantially different from that shown in FIG. 1 in that the former comprises a comparator means 20 instead of the display selecting means 4 in the latter and additionally comprises a third memory means 21.

That is the clock means 11 always counts up momentarily changing present time which is supplied to the second memory means 13 and the comparator means 20, respectively.

Similar to the foregoing embodiment, a period of time, for example, of four hours required for the making of a pound loaf of bread is previously memorized in the first memory means 12. Further, the bread making time memorized in the first memory means 12 is supplied to the second memory means 13 and the comparator means 20, respectively.

When a starting instruction is received from the starter means 16, the second memory means 13 calculates a bread making finished time by adding the required period, for example, of four hours for bread making supplied from the first memory means 12 to a present time supplied from the clock means 11 at the moment of the starting instruction, and memorize thus calculated bread making finished time. The bread making finished time is also supplied to the comparator means 20.

Figure 4:
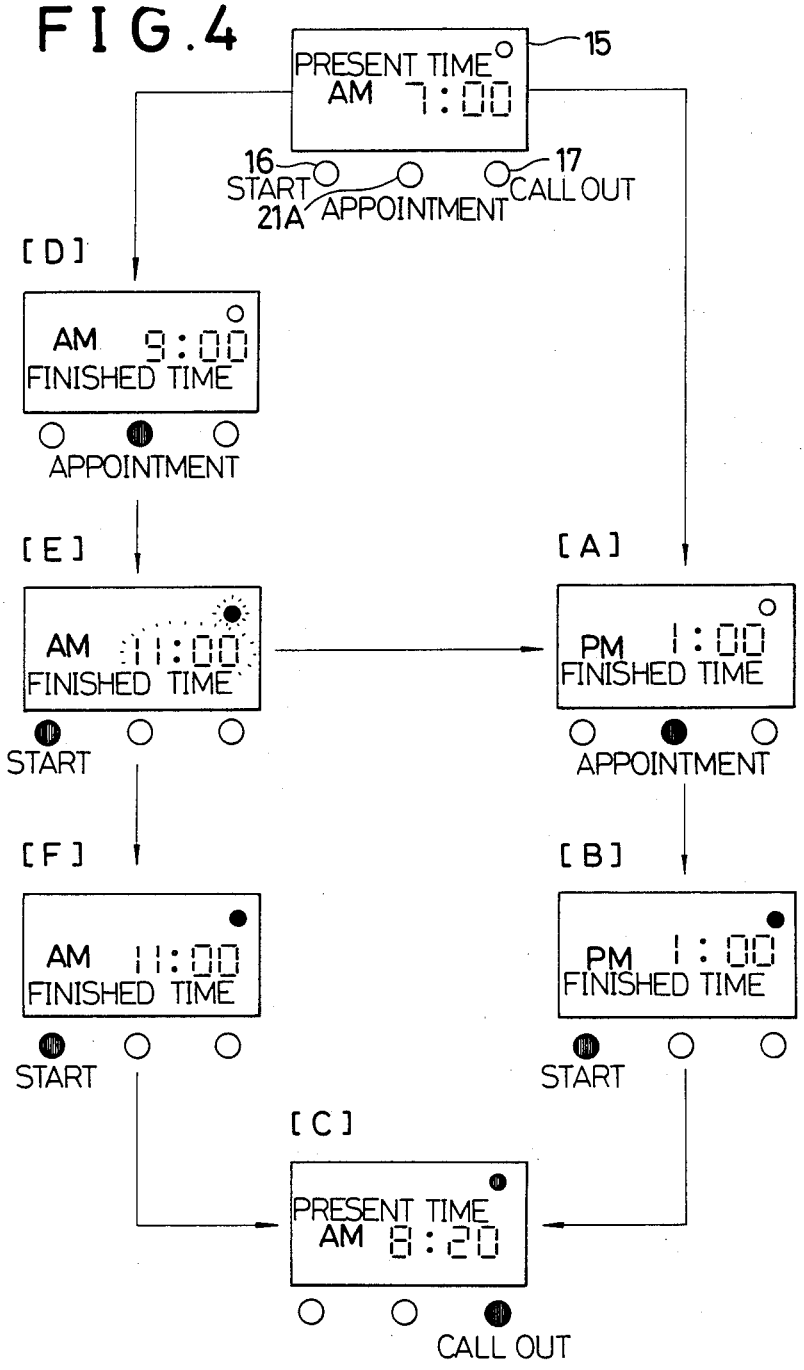
FIG. 4 is a schematic diagram illustrating an operational mode of the embodiment shown in FIG. 3.

The time display means 15 may be constituted from a displaying panel comprising such as light emitting diode and liquid crystal as shown in FIG. 4 so as to display a time transmitted from the comparator means 20.

The starter means 16 may be comprised of such as a light emitting push button switch disposed in the vicinity of the time display means 15. When the button switch is pushed by the user, it will be lighted and a starting instruction will be generated.

Similar to the starter means 16, the call out means 17 also comprised of a light emitting push button switch disposed in the vicinity of the time display means 15 will be lighted and a calling out instruction will be generated upon the operation of the button by the user.

A series of programmed controls required for bread making comprising such operations as starting in response to the starting instruction from the starter means 16 in cooperation with that from the comparator means 20, mixing and kneading, and fermenting may sequentially be carried out by the bread making means 18.

Further, the third memory means 21 is comprised of a knob 21A internally installed with a lamp, as shown in FIG. 4, for setting an appointed bread making finished time and a memory for memorizing the appointed bread making finished time set by the knob 21A. The setting of the appointed finished time may be carried out in such a manner that the user rotates the knob 21A while monitoring the displayed time on the time display means 15. By way of example, the knob 21A may be provided with a switch mechanism. Thus, when the knob 21A is first pushed, the knob 21A is lighted and an appointment setting instruction generated by the operation is transmitted to the comparator means 20 so as to interlock the display on the time display means 15 with the rotation of the knob 21A. Then, the displayed time on the time display means 15 may be changed by the rotation of the knob 21A. Thus, the appointment of a desired finished time may be attained by releasing the pushed knob 21A when the displayed time on the time display means 15 indicates the desired finished time.

The comparator means 20 will selectively transmit momentarily changing present time supplied from the clock means 11, an appointed bread making finished time supplied from the third memory means 21, or the bread making finished time supplied from the second memory means 13 to the time display means 15 in response to the signals from the starter means 16, the call out means 17, and the third memory means 21 in the following manner while, on the other hand, generates the starting instruction to the bread making means 18.

That is the comparator means 20 normally transmits momentarily changing present time supplied from the clock means 11 to the time display means 15. When the appointment setting instruction is received as described above, the comparator means 20 transmits the time generated from the third memory means 21 by the rotation of the knob 21A to the time display means 15. Thus, when the appointed time is displayed on the time display means 15 and the start means 16 is operated, the starting instruction is generated and transmitted to the comparator means 20. In response to the starting instruction, the comparator means 20 will transmit to the time display means 15 a later time of the appointed bread making finished time supplied from the third memory means 21 and the bread making finished time calculated at the moment of the starting instruction and supplied from the second memory means 13, as a result of comparing.

Therefore, if the bread making finished time is later than the appointed bread making finished time, the display on the time display means 15 will be changed from the appointed finished time to the finished time calculated with the present time upon the operation of the starter means 16. In this case, the comparator means 20 generates the finished time in such a manner that the finished time is flickeringly displayed on the time display means 15 to arouse the user's attention.

Alternatively, when an appointed finished time is displayed on the time display means 15 and the starter means 16 is operated (if the appointed finished time is equal to the finished time calculated at the present time, when the starter means 16 is operated again), the comparator means 20 calculates a bread making starting time by subtracting the bread making time memorized in the first memory means 12 from the appointed finished time displayed on the time display means 15 and monitors momentarily changing present time supplied from the clock means 11. When the momentarily changing present time coincides with the calculated starting time, the comparator means 20 will transmit a starting instruction for bread making to the bread making means 18 so as to actually start the bread making.

Furthermore, if the calling instruction is received from the call out means 17 during the bread making finished time supplied from the second memory means 13 or the appointed bread making finished time supplied from the third memory means 21 is being displayed on the time display means 15, the comparator means 20 will change the time display means 15 to display momentarily changing present time supplied from the clock means 11.

The operation of the embodiment constructed as mentioned above will now be described. As shown in FIG. 4, if the user desires at a present time of "7:00 a.m." that the bread making will be finished, for example, at "1:00 p.m.", the appointed bread making finished time is displayed on the time display means 15, shown as [A], by operating the third memory means 21. Thereafter, when the starter means 16 is operated, a bread making finished time "11:00 a.m." calculated by adding the bread making time of "four hours" to the present time "7:00 a.m." is memorized in the second memory means 13. The finished time "11:00 a.m." is compared with the appointed time "1:00 p.m." in the comparator means 20 and the later time "1:00 p.m." is displayed, shown as [B], on the time display means 15. At the same time, a starting time "9:00 a.m." is calculated in the comparator means 20 by subtracting four hours which is required for the bread making from the appointed time "1:00 p.m." and the momentarily changing present time supplied from the clock means 11 is monitored in the comparator means 20. Thereafter, when the momentarily changing present time coincides with the bread making starting time "9:00 a.m.", the starting instruction for bread making is transmitted from the comparator means 20 to the bread making means 18 and the bread making is started. The bread making will be finished at the appointed time "1:00 p.m.". Before the bread making is finished, the display of the appointed time "1:00 p.m." may be kept on the time display means 15. However, when the call out means 17 is operated, the present time, for example, "8:20 a.m." is displayed, shown as [C], on the time display means 15.

On the contrary, if an appointed time such as "9:00 a.m.", shown as [D], which has a shorter period than the required period of four hours for bread making from the present time "7:00 a.m." is set inadvertently and the starter means 16 is, thereafter, operated, then the bread making finished time "11:00 a.m." calculated by adding the required period of four hours for bread making supplied from the first memory means 12 to the present time "7:00 a.m." is memorized in the second memory means 13. Therefore, the appointed bread making finished time "9:00 a.m." supplied from the third memory means 21 is compared with the bread making finished time "11:00 a.m." supplied from the second memory means 13 in the comparator means 20 and the later time of them "11:00 a.m." is flickeringly displayed, shown as [E], on the time display means 15.

The user will be noticed his false setting by observing that there is flickeringly displayed the time "11:00 a.m." other than his appointment setting of "9:00 a.m." on the time display means 15. Thus, if the appointment setting is re-executed such as "1:00 p.m.", the time display will be reduced to the foregoing case shown as [A].

Alternatively, if the user admits the finished time "11:00 a.m.", the time "11:00 a.m." is set, shown as [F], by operating the starter means 16 again. Then the bread making means 18 is operated at the same time and the bread making will be finished at "11:00 a.m.".

In the embodiment, as has been described above, there is surely displayed a bread making finished time calculated by adding the bread making time to the present time on the time display means even if an inadvertent setting of the appointed bread making finished time corresponding to a shorter period for bread making than the actually required predetermined period for bread making is executed so that the user may surely be informed of the nearest future bread making finished time in such a case.

We claim:

1. A bread making device provided with a clock function comprising:

a starter means for generating by the operation thereof a starting instruction, a clock means for counting up present time, a first memory means for memorizing a bread making time previously set for bread making, means for adding said bread making time to the present time counted by said clock means at the moment of input of said starting instruction so as to thereby obtain a bread making finishing time, second memory means for memorizing said bread making finishing time, a display selecting means for generating normally said present time supplied from said clock means and for generating said bread making finishing time supplied from said second memory means instead of present time in response to said starting instruction, and a time display means for displaying a time generated by said display selecting means.

2. A bread making device as claimed in claim 1, wherein said clock function further comprises a call out means for calling said present time so that said time display means displays said present time from said clock means selected instead of said bread making finishing time by said display selecting means in response to an instruction from said call out means.

3. A bread making device provided with a clock function comprising:

a starter means for generating by the operation thereof a starting instruction, a clock means for counting up present time, a first memory means for memorizing bread making time previously set for bread making, means for adding said bread making time to said present time counted by said clock means at the moment of input of said starting instruction from said starter means so as to thereby obtain a bread making finishing time, a second memory means for memorizing said bread making finishing time, a third memory means for memorizing an appointed bread making finishing time, a time display means normally displaying present time supplied from said clock means and for displaying, after the operation of said starter means, the bread making finishing time supplied from said second memory means or the appointed bread making finishing time supplied from said third memory means, a comparator means generating output when said starter means is operated as a result of comparing the bread making finishing time supplied from said second memory means with the appointed bread making finishing time supplied from said third memory means so as to display a later time on said time display means, and means for calculating and memorizing a starting time for bread making corresponding to said later time so as to instruct the starting of bread making when the present time supplied from said clock means coincides with said starting time.

4. A bread making device as claimed in claim 3, wherein said comparator means generates said bread making finishing time for displaying same on said time display means when the bread making finishing time is later than said appointed bread making finishing time.

5. A bread making device as claimed in claim 3, wherein said clock function further comprises a call out means for calling said present time out from said clock means after the operation of said starter means so that said display means displays said present time in response to a signal from said call out means.

* * * * *